US007263805B2

(12) United States Patent
Chapus

(10) Patent No.: US 7,263,805 B2
(45) Date of Patent: Sep. 4, 2007

(54) LOW SHELTER WITH ARTICULATED ROOF ELEMENTS FOR USE AS A SWIMMING POOL ROOF

(75) Inventor: Serge Chapus, Sirac (FR)

(73) Assignee: Abrisud, L'Isle Jourdain (FR)

( * ) Notice: Subject to any disclaimer, the term of this patent is extended or adjusted under 35 U.S.C. 154(b) by 681 days.

(21) Appl. No.: 10/480,034

(22) PCT Filed: Jun. 4, 2002

(86) PCT No.: PCT/FR02/01890

§ 371 (c)(1),
(2), (4) Date: Dec. 8, 2003

(87) PCT Pub. No.: WO02/101178

PCT Pub. Date: Dec. 19, 2002

(65) Prior Publication Data

US 2004/0187397 A1 Sep. 30, 2004

(30) Foreign Application Priority Data

Jun. 8, 2001 (FR) ..... 01 07478
Sep. 7, 2001 (FR) ..... 01 11569
Nov. 27, 2001 (FR) ..... 01 15288

(51) Int. Cl.
*E04B 1/346* (2006.01)

(52) U.S. Cl. ..... 52/67; 52/86; 52/66; 52/69; 4/498; 47/17; 135/906

(58) Field of Classification Search ..... 52/DIG. 17, 52/2.11, 3, 5, 64, 63, 66, 67, 169.6, 200, 73, 52/69, 71, 86; 135/906; 4/498; 47/17
See application file for complete search history.

(56) References Cited

U.S. PATENT DOCUMENTS 2,610,366 A * 9/1952 McKee et al. ..... 49/40

(Continued)

FOREIGN PATENT DOCUMENTS

FR 2 572 114 A 4/1986

(Continued)

*Primary Examiner*—Robert Canfield
*Assistant Examiner*—Dan Kenny
(74) *Attorney, Agent, or Firm*—Akerman Senterfitt; Stephan A. Pendorf; Peter A. Chiabotti

(57) ABSTRACT

A low shelter swimming pool roof system is provided. The system can include, over a portion (P') at least of its length, juxtaposed roof elements (I') and juxtaposed roof elements (I). The distance that delimits the external chord of each of the longitudinal edges (220*a*') and (220*b*') of the roof elements (I') resting on the support edge (S) of the pool and connected by two roof arcs (210') can be shorter than the distance which delimits the internal chord of the two longitudinal edges (220*a*) and (220*b*) the roof elements (I) of the other portion (P) resting on the support edge (S) of the pool and connected by two roof bows (210). Such an arrangement enables the first portion (P') of roof elements (I') to be nested in the second portion (P) of relatively larger roof elements (I) thereby partially exposing the pool over a length corresponding to the displacement of the mobile portion (P') of roof elements (I').

27 Claims, 13 Drawing Sheets

U.S. PATENT DOCUMENTS 2,728,115 A * 12/1955 Cornelius ..... 52/67
3,009,211 A * 11/1961 Hansen et al. ..... 52/66
3,028,872 A * 4/1962 Cresswell ..... 135/94
3,443,265 A * 5/1969 Hauck ..... 4/498
4,175,361 A * 11/1979 Kumode ..... 52/66
4,783,861 A * 11/1988 Leurent ..... 4/498
4,807,312 A * 2/1989 Baus ..... 4/607
4,876,828 A * 10/1989 Brill ..... 52/23
5,156,195 A * 10/1992 Wehler et al. ..... 160/202

FOREIGN PATENT DOCUMENTS

FR 2 776 000 A 9/1999
FR 2 781 511 A 1/2000

* cited by examiner

LOW SHELTER WITH ARTICULATED ROOF ELEMENTS FOR USE AS A SWIMMING POOL ROOF

CROSS REFERENCE TO RELATED APPLICATION

This application is a national stage of PCT/FR02/01890 filed Jun. 4, 2002 and based upon French Application No. 01/07478 filed Jun. 8, 2001, based upon French Application No. 01/11569 filed on Sep. 7, 2001, and based upon French Application No. 01/15288 filed on Nov. 27, 2001 under the International Convention.

FIELD OF APPLICATION OF THE INVENTION

The present invention relates to the field of low shelter swimming-pool roofing and, in particular, swimming-pool roofing with moveable components.

DESCRIPTION OF PRIOR ART

Several types of roofing for swimming pools exist in the prior art, but the present invention concerns, in particular, swimming pool roofing that are generally referred to as "low shelter", comprising roof elements arranged in a juxtaposed manner along the length of the swimming pool and each able to perform a rotational movement on one of their longitudinal sides so as to be able to partially open, and thus, give access to the water in the swimming pool. For a better understanding of the claimed subject matter, it should be noted that the longitudinal, transversal and lateral positions of the roof elements and/or their constitutive parts are considered relative to the longitudinal, lateral and transversal axes of the pool. The roof elements are of the type each having a cover formed of panels of translucent material, such as double-walled polycarbonate, and with a rigid frame that can be light and resistant to support the transparent cover, The frame can be formed of arcs arranged in transversal planes and spaced by cross-ties with two longitudinal end cross-ties defining two longitudinal sides with the roof element. These two longitudinal sides rest on the edges of the pool defining a support surface for the roof elements. The support edges of these roof elements are usually constituted by the longitudinal edges of the swimming pool.

In order to partially open such a swimming pool roofing system partially and to and enjoy the fresh air, the roof elements are individually partially opened in order to modulate the opening of the pool to the outside environment. In order to do this, at least one of the longitudinal sides of the frame of the roof elements is mounted in an articulated arrangement around a fixation lug anchored in the support edges of the pool in an angular expansion plane. The other side is intended to receive two struts with their heads penetrating each extremity of the side with their feet then resting on the support edges of the pool to block the struts between the edges of the pool and the roof element, which is thus maintained in an inclined position relative to the ground, as required by a partially opened configuration. This fixed arrangement of a low shelter roof system in a partially open position has the following disadvantages:

it limits opening the pool roofing system to grant access to the pool to the limited access provided by merely moving a roof element to the partially open and fixed position;

for handling purposes, it requires the use of two struts as lever arms for each of the roof elements;

it often requires two people to lift each roof element to the partially open position;

it exposes the partially open roof elements to wind, that tends to destabilize them;

it takes a relatively long time to install, particularly when there are several roof elements; and it has other disadvantages.

Many improvements have been added in recent years to simplify the lifting operation for the roof elements using a sliding strut along the side acting as lever by applying a lifting effort at the middle of the side, or furthermore with the help of various lifting systems to reduce effort.

Despite these various innovations making significant improvements for moving the roof elements from a closed position to a partly open position, the applicant has noted that the opening of the roof elements of a swimming pool roof system remains a difficult handling operation. Even though the process has been simplified, the weight of the roof elements still renders this process difficult and strenuous. This handling even becomes a major problem when the swimming pool and the roof elements covering it are of large dimensions, or when it is necessary to lift several of them.

BRIEF DESCRIPTION OF THE INVENTION

Starting from this, the applicant has envisaged a new roofing concept for swimming pools, combining the advantages of low shelters with roof elements articulated along their longitudinal sides with those of high shelters with telescopic roof elements.

According to the invention, the swimming pool roof system for low shelters of the type where each constituent roof element is composed of a cover resting on a frame formed of two arcs, which transverse the pool, and separated by longitudinal cross-ties with two longitudinal parallel sides, with at least one of them mounted in an articulated way relative to the edge of the pool so that the roof element can move from a closed position to a partially open position, is notable in that the above-mentioned swimming pool roof system includes, along at least one portion of its length, juxtaposed roof elements whose distance can be defined by the external cord of the two longitudinal sides resting on the support edge of the pool and linking the two arcs is less than the distance defined by the internal cord of the two longitudinal sides resting on the support edge of the pool and connecting the two arcs of the juxtaposed roof elements of the other portion of the swimming pool roof system to enable nesting of the first portion of roof elements in the second portion of roof elements to partially open up the swimming pool along a length depending on the displacement of the mobile portion of roof elements. In such a system, the first roof elements can be relatively smaller than the second roof elements so that the first roof elements can be nested underneath the second roof elements.

This new concept of a swimming pool roof system for low shelters is of great interest since it provides the double possibility of opening up the swimming pool either on one side or the other along the longitudinal plane of the pool by tilting the roof elements either from one side or from the other of the swimming pool by displacement of one portion of roof elements into the other portion of roof elements. Furthermore, the arrangement of associating several roof elements one behind the other in a mobile portion, makes it possible to have nesting in two widths only, thus limiting the dimensions on the support surface and even providing the possibility of making the whole roofing assembly rest on the curb of the swimming pool.

The applicant has envisaged several variants of this above-mentioned concept in its most elementary expression.

Thus, according to a first variant with two possibilities, either the portion with the relatively smaller roof elements is mounted so as to be mobile along and/or outside of the swimming pool and is displaced beneath the portion of relatively larger roof elements to be partially or totally covered by the latter, or the inverse, where the portion with the relatively larger roof elements is mounted in a mobile way along and/or outside the swimming pool and is displaced above the portion of the relatively smaller roof elements which it covers partially or totally.

According to another variant with two possibilities, when the swimming pool roof system includes a single mobile portion of roof elements, the roof elements can preferably be situated at one end of the swimming pool. On the other hand, when the swimming pool roof system includes two mobile portions of roof elements, the roof elements can preferably be situated at the two ends of the swimming pool. In the first configuration, the mobile portion of roof elements can be displaced from one end of the swimming pool which it opens up progressively towards the other end which remains closed. In an alternative configuration where the other portion of fixed roof elements is set, such as in the second arrangement, the two mobile portions of roof elements can be moved towards each other, progressively opening up the two ends of the swimming pool, and towards the middle of the latter which remains closed and where the central portion of fixed roof elements is to be found.

Even though the fundamental concepts of the invention have been described above, other details and characteristics of the invention will appear more clearly by reading the following description given as a non-limiting example and relative to the appended drawings, of an embodiment of a swimming pool roof system according to the invention.

DETAILED DESCRIPTION OF THE DRAWINGS

Figure 1:
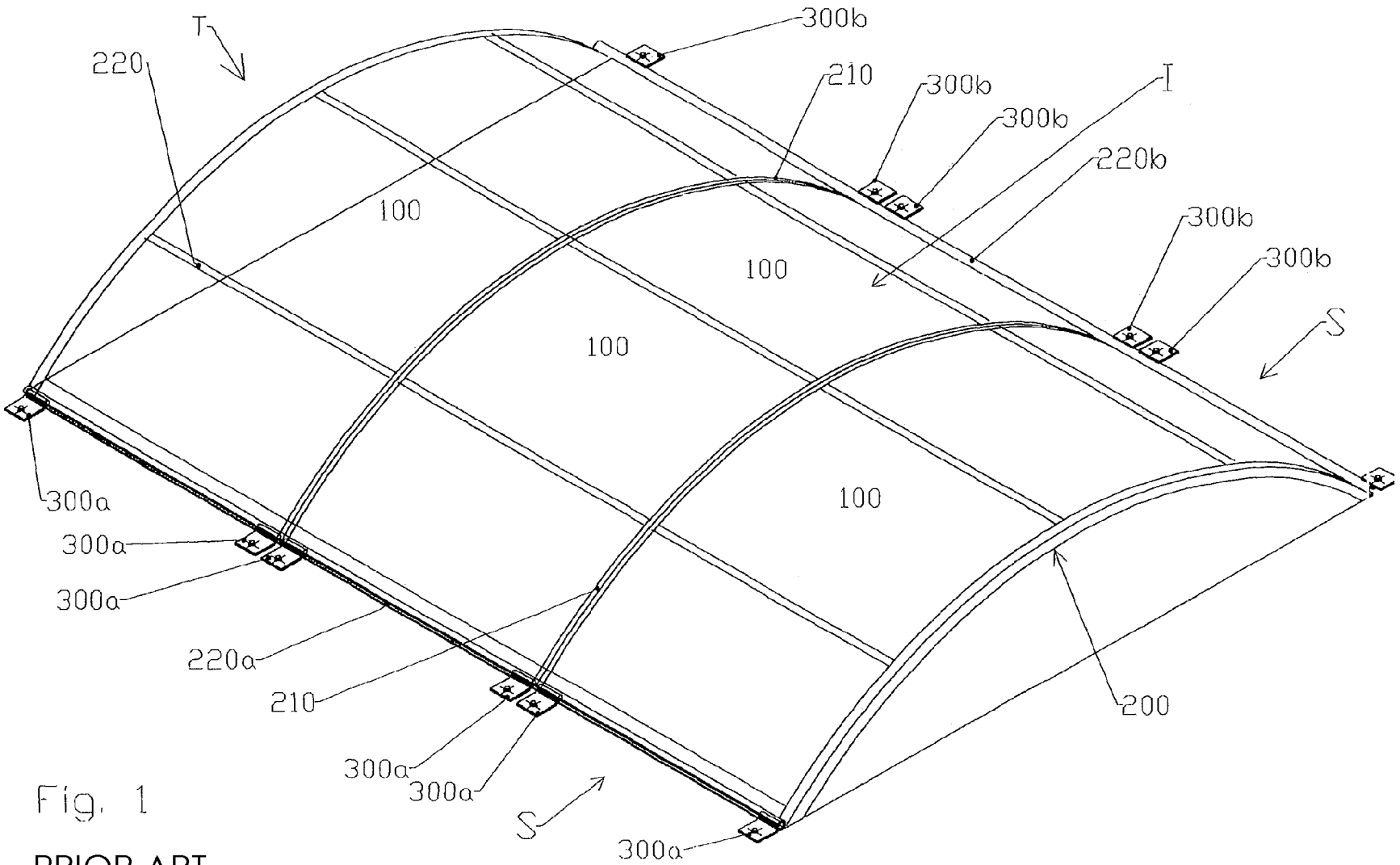
Fig. 1 PRIOR ART
FIG. 1 is an isometric view in perspective of a prior art swimming pool roof for low shelters, of standard design and shown in the closed position.

The drawing in FIG. 1 shows a swimming pool roof system according to prior art, generally referred to as a low shelter and shown in closed position. This swimming pool roof system, reference T in its assembly, usually includes a series of roof elements I of the type each composing a cover formed of panels in translucent material 100 such as double-walled polycarbonate and a light and resistant rigid frame 200 in the form of arcs 210 arranged in planes that transverse the pool and separated by cross-ties 220 to support said cover. The two end cross-ties 220 of the frame define the two longitudinal sides 220*a* and 220*b* for the roof elements I that are retained on the longitudinal edges of the pool defining a support surface, by means of fixation lugs with references 300*a* and 300*b* respectively, anchored in a detachable manner in the edges S or in the curbs covering the edges.

Figure 2:
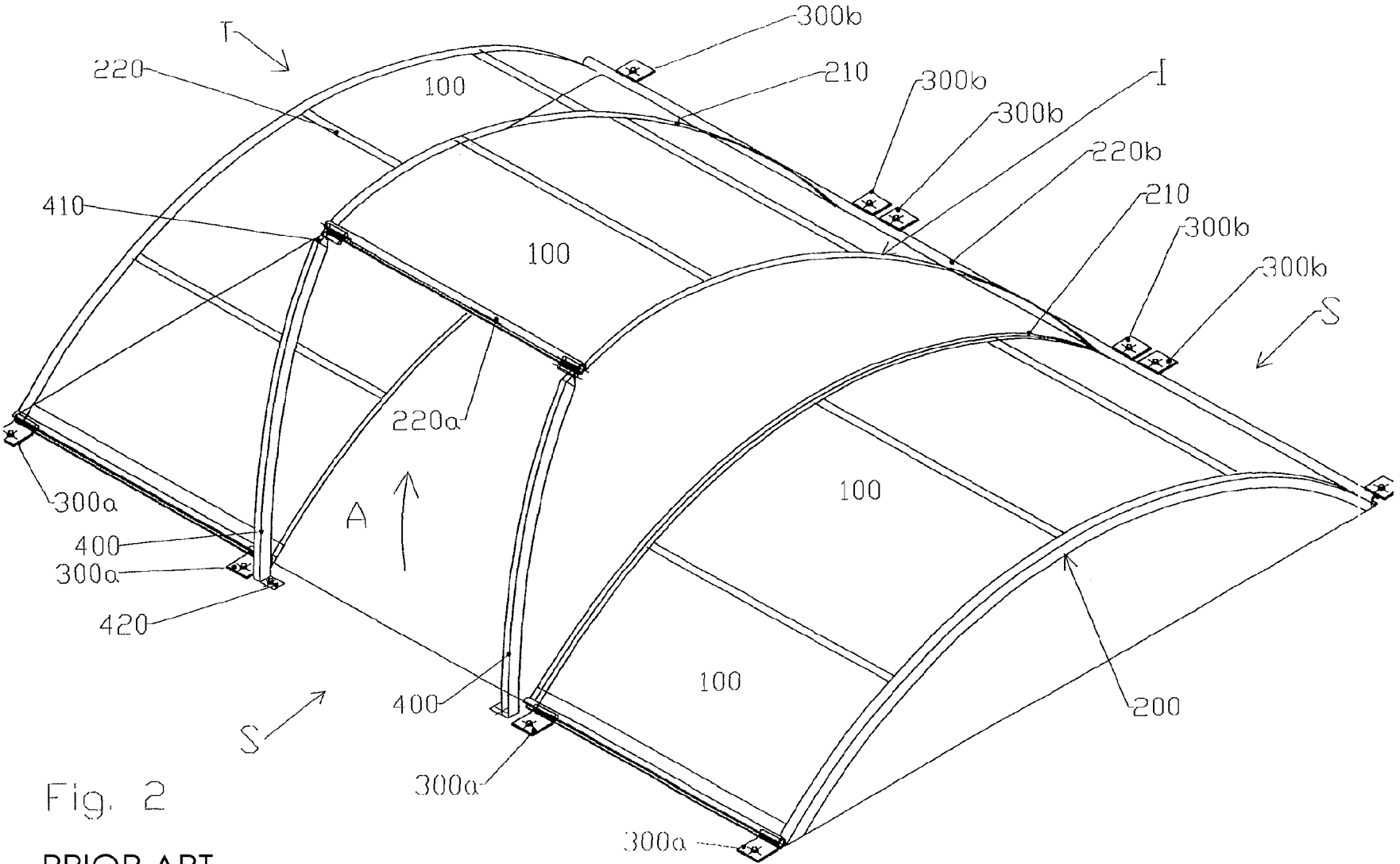
Fig. 2 PRIOR ART
FIG. 2 is an isometric view in perspective of the swimming pool roof of the drawing of FIG. 1, shown in partially opened position.

As can be seen in the drawing of FIG. 2, one (the central) of the roof elements I is shown in a partially open position, thus partially opening the swimming pool. In order to do this, one side 220*a* of the two longitudinal sides of the frame of this roof element I is freed from its fixation lugs 300*a* thus enabling the roof element I to follow a tilting movement towards its second side 220*b* around the two fixation lugs 300*b*, according to an angular expansion (represented by the arrow A) in a plane that transverses the pool. The roof element I is held in this partially open position by means of two separators formed by struts 400 whose heads 410 penetrate each end of the side 220*a* and whose feet 420 are supported on the edge flanges S of the pool in which they become anchored in place of the fixation lugs 300*a* that have been freed.

Figure 3:
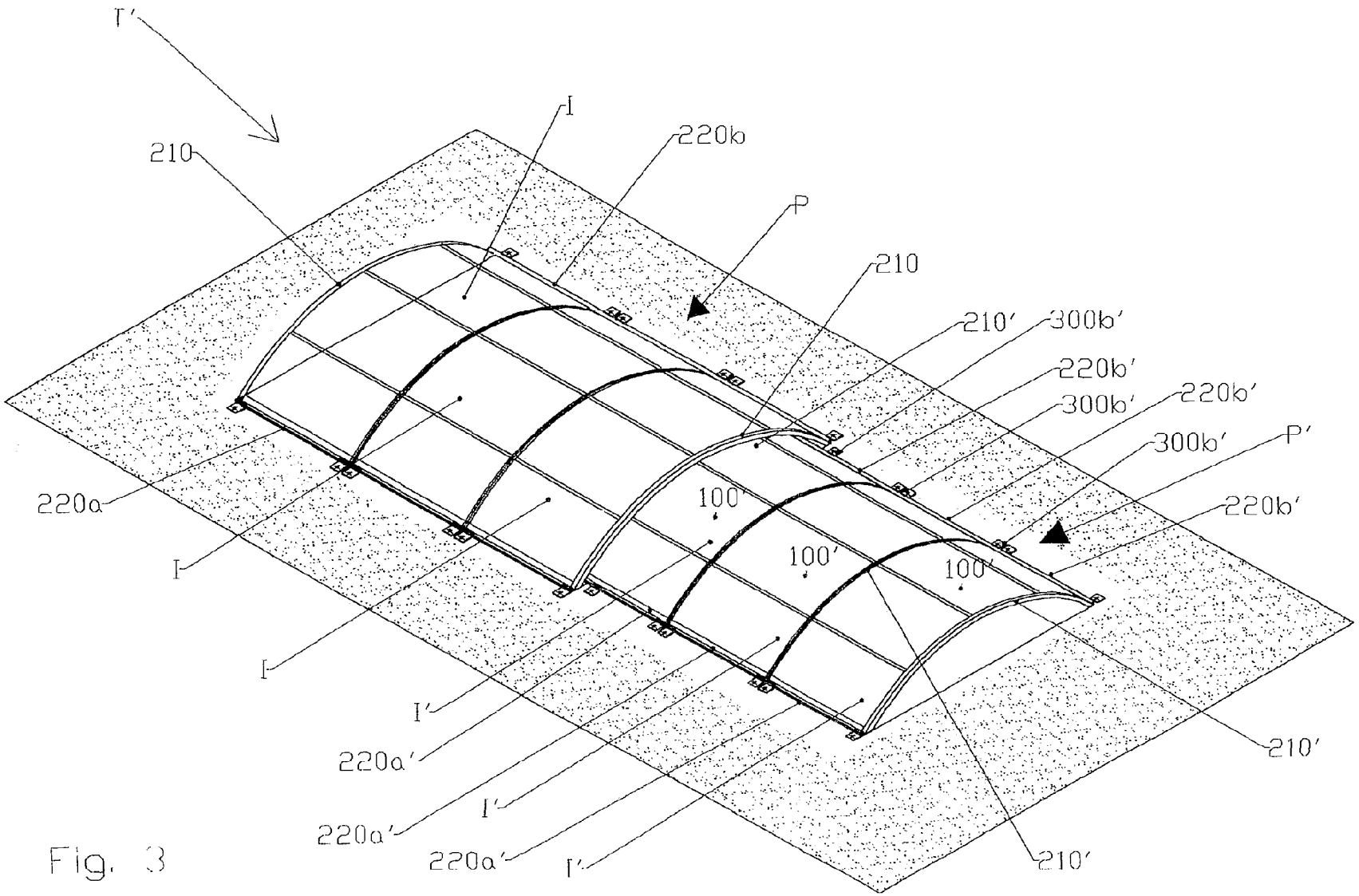
FIG. 3 is an isometric view in perspective of a swimming pool roof system according to the design of the invention and shown in closed position.

The drawing of FIG. 3 shows a swimming pool roof system with reference T' as a whole and shown according to the original concept of the invention. The swimming pool roof system T' can include, at one of the ends (right side) of the swimming pool, a portion P' with three juxtaposed roof elements I' whose distance can be defined by the external cord of the two longitudinal sides 220*a*' and 220*b*' resting on the support edge S of the pool and linking the two arcs 210'of each roof element I' is less than the distance defined by the internal cord of the two longitudinal sides 220*a* and 220*b* resting on the support edge S of the pool and connecting the two arcs 210 of each of the three juxtaposed roof elements I of the other portion P of the system T' situated at the other end (left side) of the swimming pool, all three being of standard design just like the roofing T.

Figure 4:
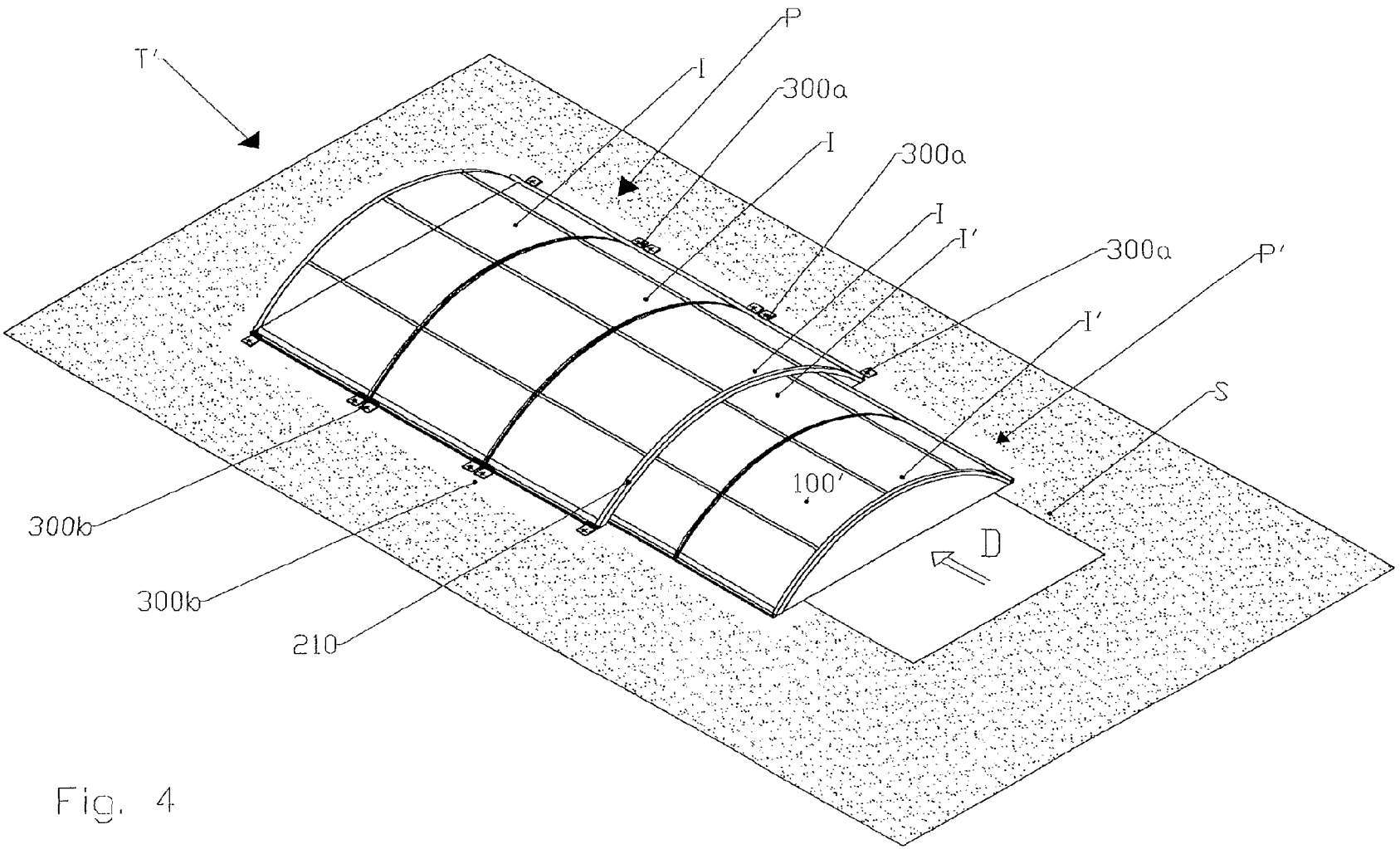
FIGS. 4, 5 and 6 are isometric views in perspective of the swimming pool roof system of the drawing of FIG. 3, shown in three positions for covering the swimming pool.
Figure 5:
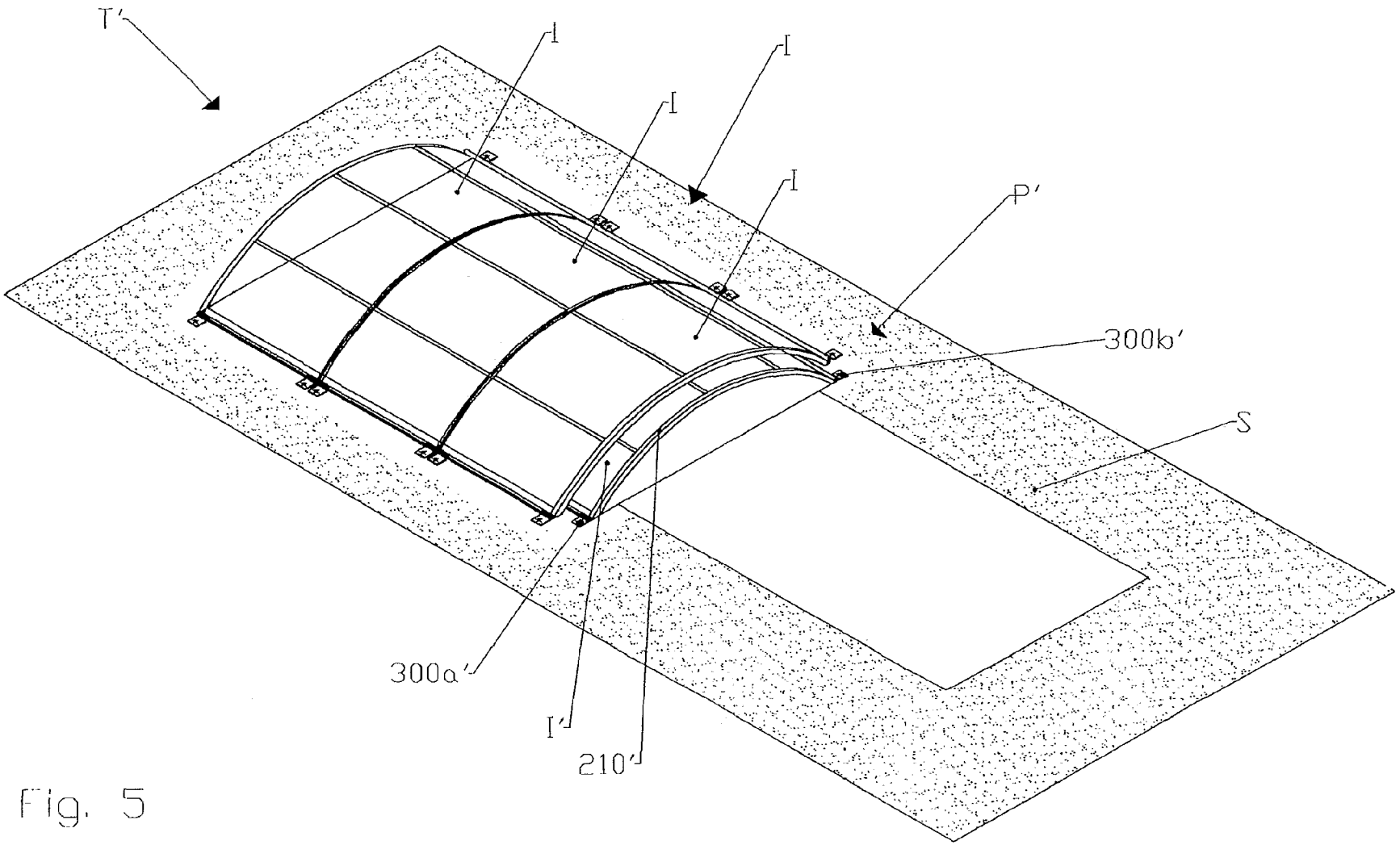
Figure 6:
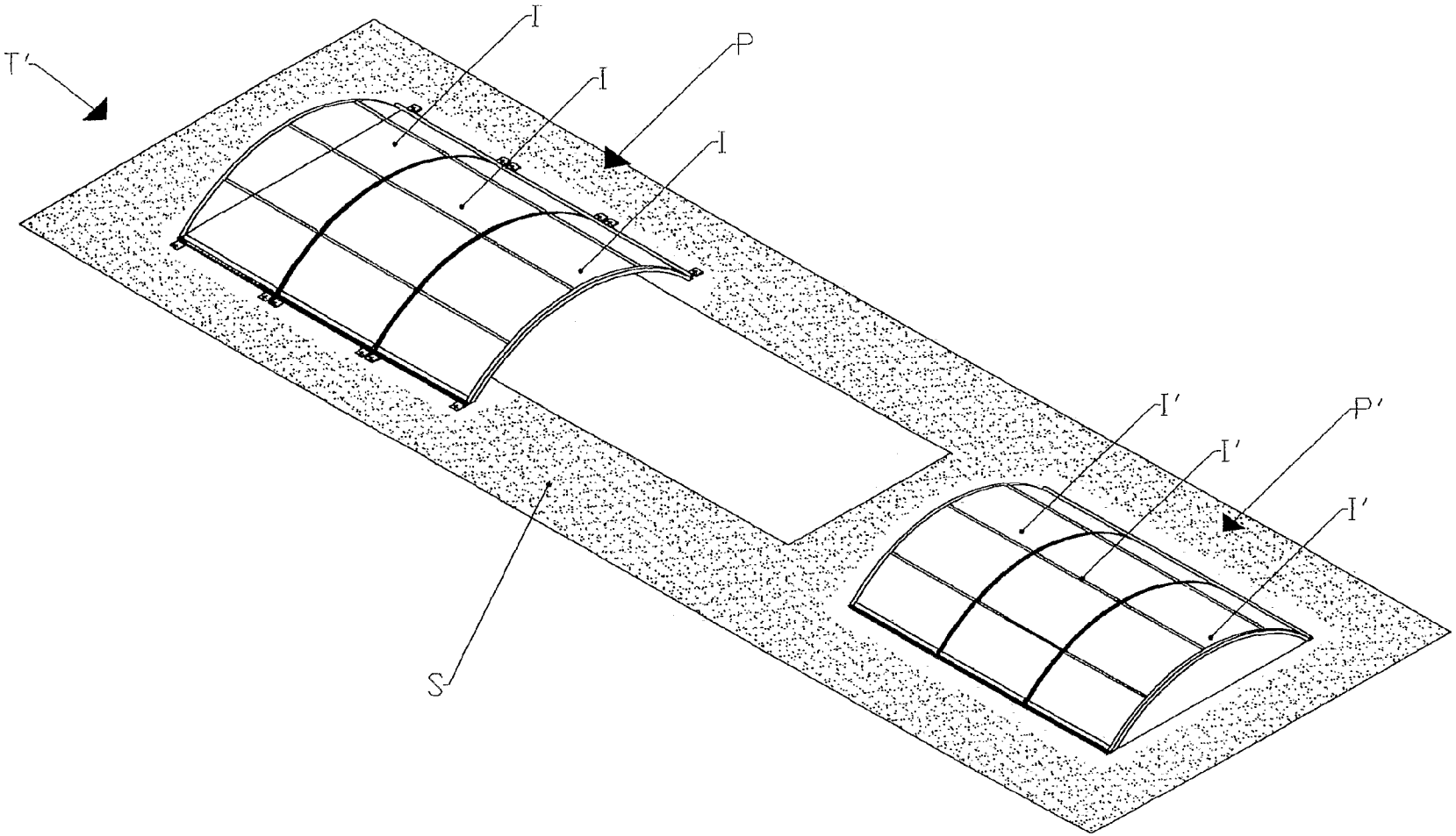
Figure 9:
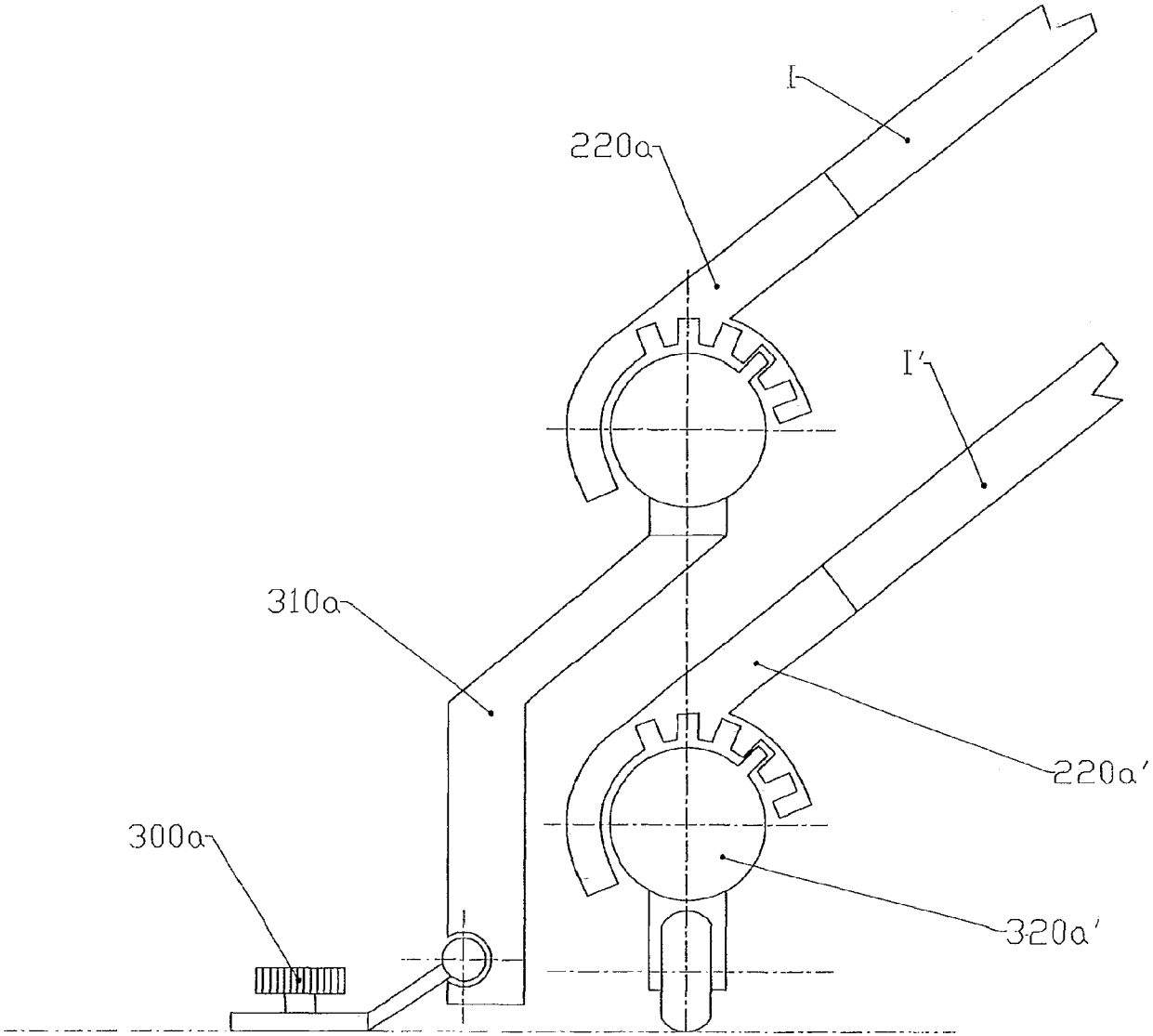
FIG. 9 is a partial view in vertical section of two swimming pool roof elements of a mobile portion and a non-mobile portion.
Figure 10:
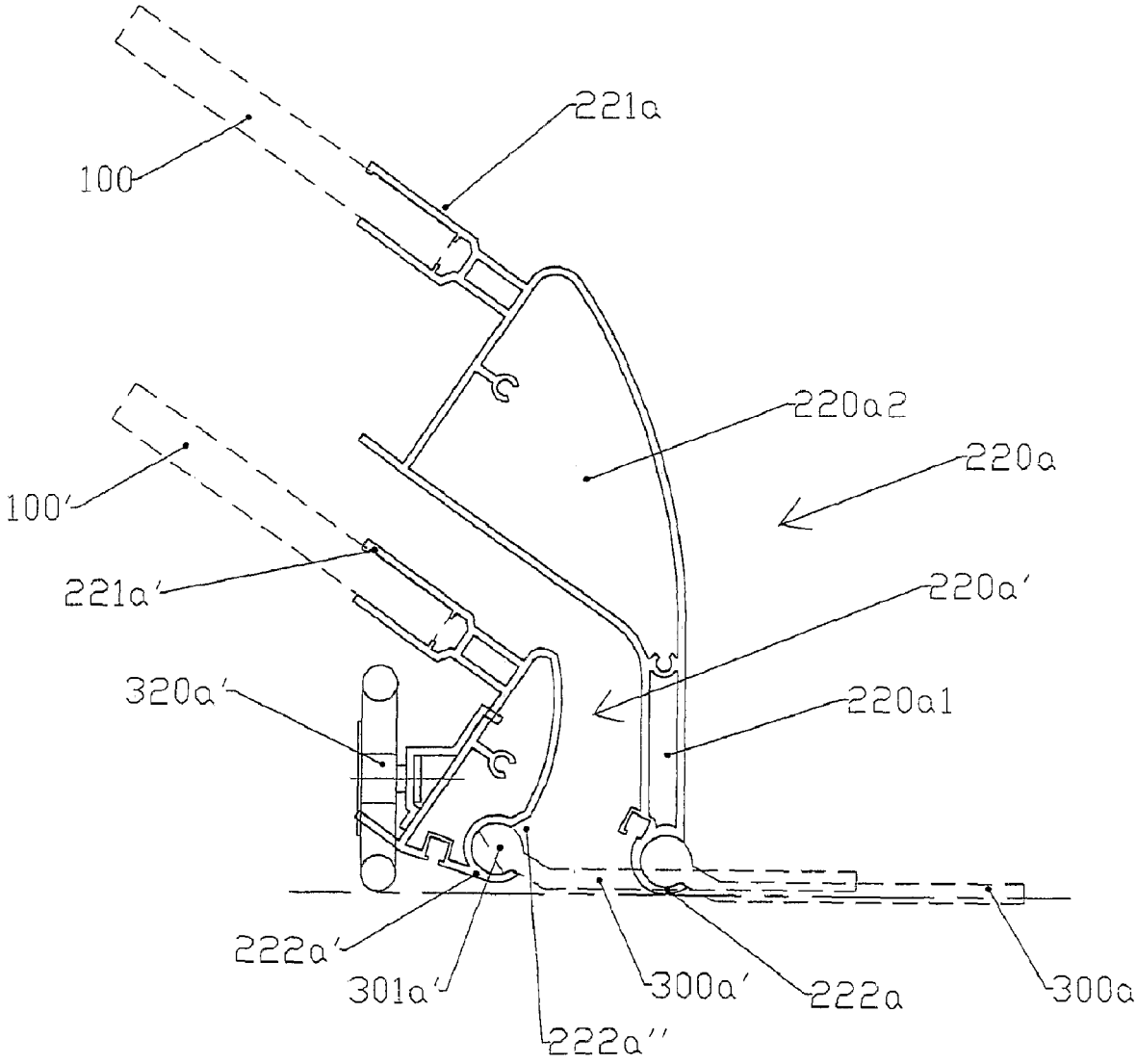
FIG. 10 is a partial view in vertical section of another embodiment of two swimming pool roof elements of a mobile portion and a non-mobile portion.

Advantageously, the two longitudinal sides 220*a*' and 220*b*' of the roof elements I' of the portion P' rest on the support edge S of the pool via rolling or any other suitable displacement means, as shown in the drawing of FIG. 9 or FIG. 10. Once the fixation lugs 300*a*' and 300*b*' have been freed from their anchoring in the above-mentioned support edge S as shown in the drawing of FIG. 4, the portion P' of roof elements I' (arrow D) can be displaced towards the portion P of roof elements I, where the roof elements I' nest inside the roof elements I. This change in arrangement (arrow D) of the portion P' from an intermediate position shown in FIG. 4 to a more nested position shown in FIG. 5, makes it possible to open up the swimming pool progressively at one end. The advantage of covering up the portion P' by the portion P such as shown in the drawing of FIG. 5, is to have a swimming pool entirely covered at its left end and entirely open at its right end. Such a configuration cannot be achieved by the articulated movements (arrow A of FIG. 2) of the roof elements I of the swimming pool roof system T. It should be noted that the mobile portion P' can be displaced not only along the support edge S, but also along the outside of the swimming pool, as shown in the drawing of FIG. 6.

As can be seen in the drawing of FIG. 3, the tightly sealed link between the two portions P and P' of the swimming pool roof system T' in its closed position is ensured by a partial mutual nesting of the two neighboring roof elements I and I' with overlap of the end arcs 210 and 210' of each of the nested roof elements. By installing a brush type joint in the usual way in the internal face of the end arc 210 of the roof element I of the portion P so that the latter remains in permanent contact with the subjacent end arc 210' and/or with the panels 100' of the cover of the mobile portion P', the sealed link of the cover of the roofing T' is guaranteed between the two portions P and P' whatever the outer position of the latter, see FIG. 3, such as the partially nested swimming pool roof system shown in FIG. 4 or totally nested swimming pool roof system shown in FIG. 5.

Figure 7:
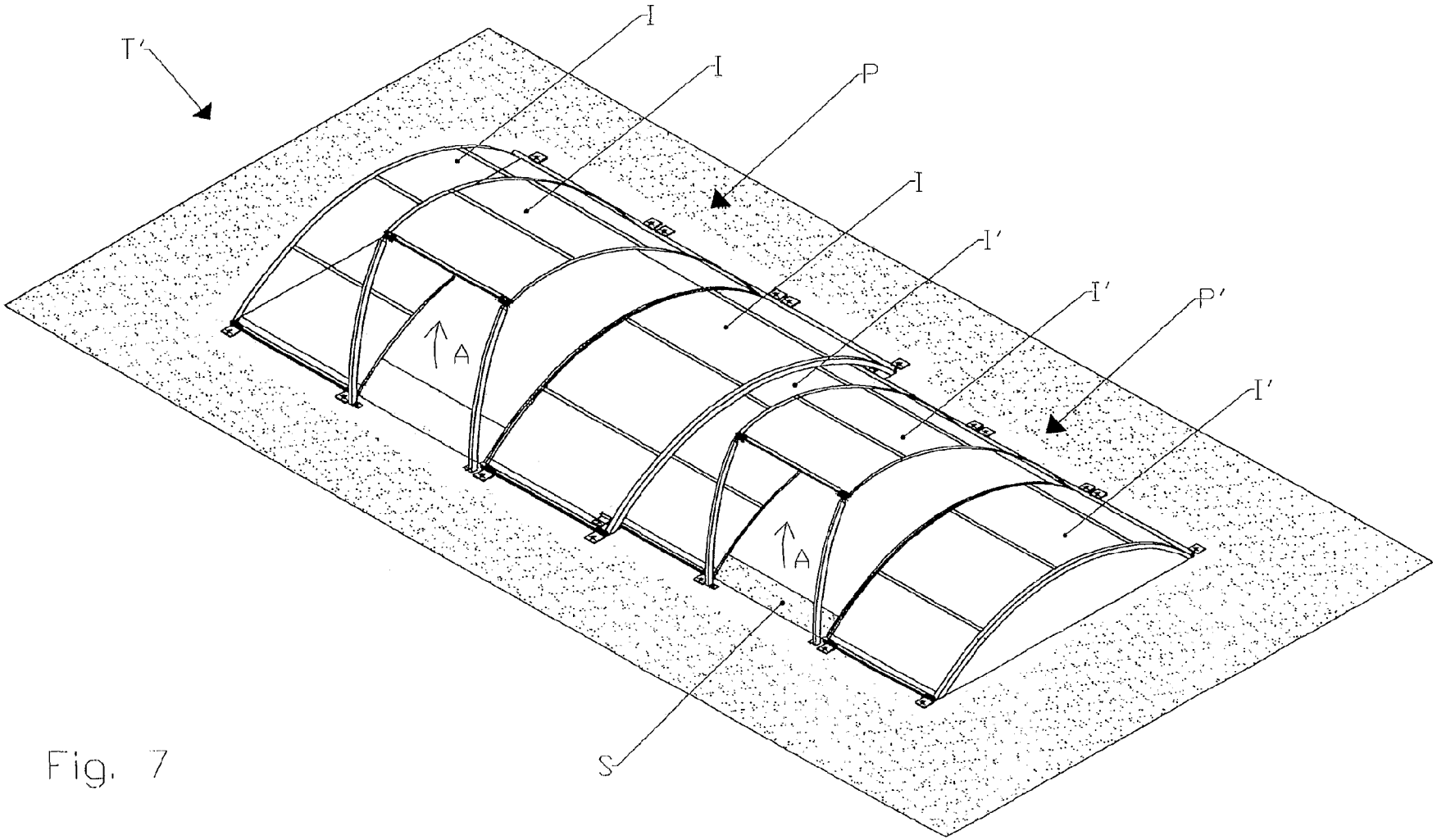
FIG. 7 is an isometric view in perspective of swimming pool roof system of the drawing of FIG. 3, showing two modes of opening the roof elements.

The roof elements I' of the mobile portion P' include mutual linking structure that can be dissociable, on the one hand, to allow their free articulation (arrow A of FIG. 7) relative to the support edge S of the pool. On the other hand, the mutual linking structure can be non-dissociable, to allow the roof elements I' stowed or nested together in FIG. 5 to be pushed in the direction of the arrow D and moved back in the reverse direction of the arrow D, such that it suffices to push and/or pull the portion P' at any anchoring point whatsoever in order to displace the roof elements I'. Thus, when the linking means are dissociated as shown in FIG. 7, the roof elements I and I' of the swimming pool roof system T' can provide the standard advantages of the low shelter of the roofing T by allowing the partly open position by the articulation A of the roof elements I and I' on the support edge S of the pool and when the linking means are non-dissociated as shown in the drawing of FIG. 4, the roof elements I' of the portion P' enabling the open position by displacing the nested, or stowed, roof elements I' one after the other, along (FIGS. 4 and 5) and/or outside (FIG. 6) the edge of the pool.

According to a first preferred embodiment of the swimming pool roof system, the above-mentioned mutual linking structure can include wings of the arcs 210' that can be arranged to at least partially extend or overhang the prolongation of the panels of translucent material cover 100' to ensure partial sealed covering of the juxtaposed roof elements I' of the swimming pool roof system T' in closed position, are provided with a removable device for solidarization with the arc 210' of the adjacent roof element I'. This removable solidarization device (not shown) can be adapted by those skilled in the art, for example with a male-female assembly preformed respectively in the faces in contact with the wings and the arcs 210.

Figure 8B:
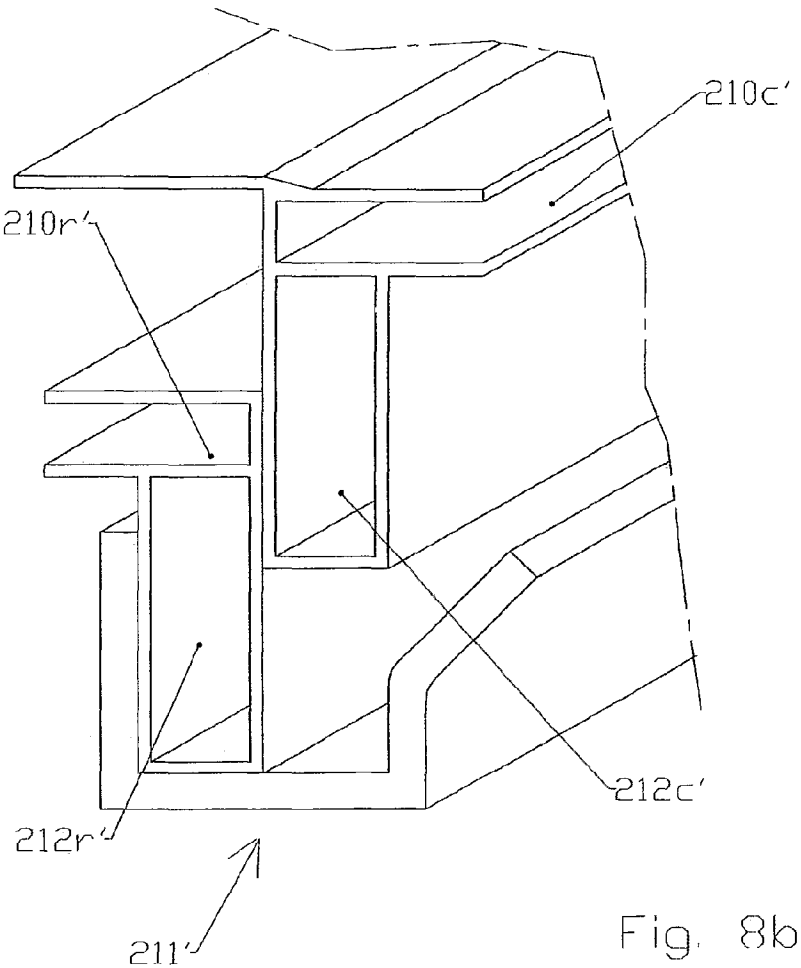
FIGS. 8*a* and 8*b* are partial views in perspective of two adjoining arcs of two swimming pool roof elements of a same portion, shown in two different positions.
Figure 8A:
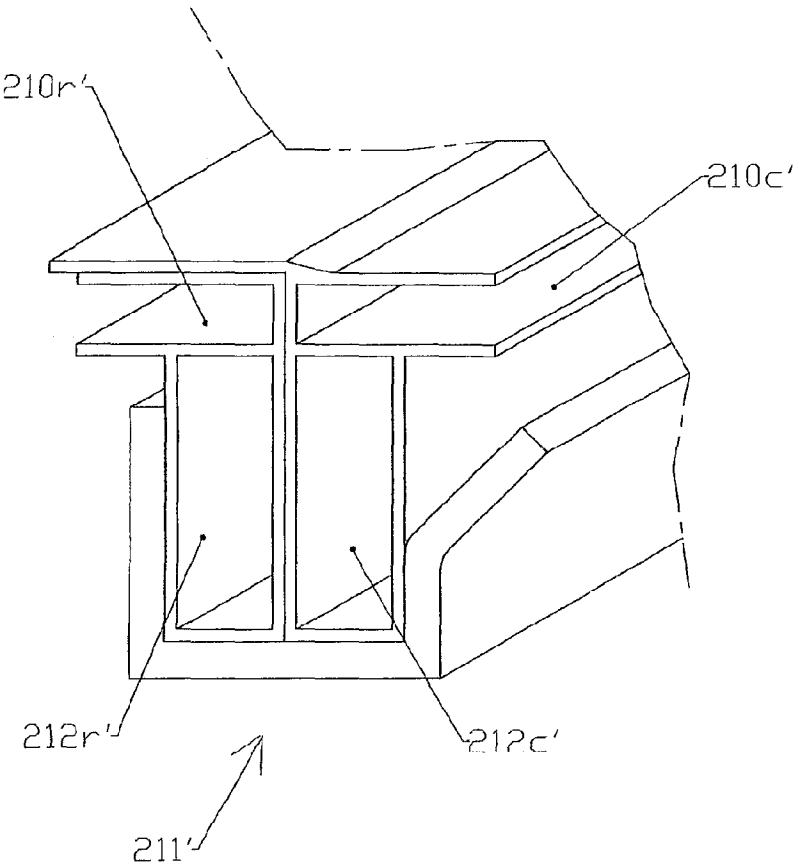

According to a second preferred embodiment of the swimming pool roof system, shown in more detail in the drawings of FIGS. 8*a* and 8*b*, each of the above-mentioned linking structure for linking two contiguous arced couplings (210*r*' and 210*c*') for the covered roof element I' and for the covering roof element I (comprising the extended wings) of the mobile portion P' is constituted of a U-profile 211' which, intended to take the shapes of the rectangular lower profiles 212*r*' and 212*c*' of said two contiguous arcs, is made integral with the rectangular profile 212*r*' of the arced coupling 210*r*' of the covered roof element I' in such a way that the rectangular profile 212*c*' of the arced coupling 210*c*' of the covering roof element I can be lodged and blocked in the U-shaped profile 211' (see FIG. 8*a*) during the lowering movement of the covering roof element I into its closed position and inversely, to release the U-shaped profile 211' (see FIG. 8*b*) during the lifting movement of the same roof element I to obtain a partially open position. Preferably, the upper part of the branch of the above-mentioned U-shaped profile 211' not firmly attached to the arced coupling 210*r*' of the covered roof element I' is flared to facilitate engaging the rectangular lower profile 212*c*' of the arced coupling 210*c*' of the covering roof element I with play, during its lowering movement into the closed position.

According to a further preferred embodiment of the swimming pool roof system, the arcs 210 of the roof elements I of the fixed portion P have the same radius of curvature as the arcs 210'of the roof elements I' of the mobile portion P'. Thus, with the same arcs 210 and even the same roof elements I, it is possible to produce either fixed roof elements I or mobile roof elements I'. In order to respect the concept of the invention which consists, at the level of their bearing on the support edge S, in differentiating the distance defined by the external cord of the two longitudinal sides 220*a*' and 220*b*' of the juxtaposed roof elements I' of the mobile portion P', from the distance defined by the internal cord of the two longitudinal sides 220*a* and 220*b* of the juxtaposed roof elements I of the other portion P, the applicant has envisaged profiling the two longitudinal sides 220*a*, 220*b* and 220*a*', 220*b*' of the roof elements I and I' so as to receive in a removable and/or adjustable manner, either the fixation lugs 300*a* of the roof elements I on the support edge S, or the displacement means 320*a*' of the roof elements I' along the edge S.

As can be seen on the drawing of FIG. 9, illustrating a first form of embodiment of the swimming pool roof system, the longitudinal side 220*a* of the roof element I has the same profile as that of the longitudinal side 220*a*' of the roof element I', such that when engaging the fixation means 310*a* in the side 220*a*, to be associated with the lugs 300*a*, and in the side 220*a*', the rolling means 320*a*' ensuring the displacement of the roof element I', it is possible, through the raised and offset configuration of the fixations means 310*a*, to lift the roof element I relative to the roof element I' while increasing the bearing cord at ground level of the roof element I to ensure that there is no rubbing between the two roof elements I and I' and free mobility of the latter (I') inside the former (I).

It is to be noted that the longitudinal sides 220*a*, 220*b* and 220*a*', 220*b*' are preformed to receive the fixation means 310*a* and the rolling means 320*a*', around axes parallel to the longitudinal axis of the pool, in such a way as to adapt to the different radii of the curvature of the arcs in function of the width of the pools. Therefore, whatsoever the curvature of the arcs, it will be possible to use the same fixation means 310*a* and rolling means 320*a*', then suitably placed by adjusting the angle of inclination correctly following the profile of the longitudinal sides.

According to a second form of embodiment of the swimming pool roof system, shown in the drawing of FIG. 10, the longitudinal side 220*a* (shown in thick lines) of the roof element I of the portion P does not have the same profile as that of the longitudinal side 220*a*', of the roof element I'

(shown in fine lines) of the mobile portion P'. Thus, the longitudinal cross-tie 220*a*' of the mobile roof element I' is set at its upper part in the usual way and facing towards the internal side of the roof element I' with a projecting inclined groove 221*a*' to grab and retain the edge of the panel 100' (shown in a line of dots and dashes), and at its lower part and facing towards the external side of the roof element I', with a coupling organ 222*a*' in order to retain, via the fixation lugs 300*a*' (shown in a line of dots and dashes) the roof element I' on the edge S of the pool. The coupling organ 222*a*' shown is of the type formed following the profile of the cross-tie of the side 220*a*' along a runner of circular cross-section open to the exterior of a longitudinal groove 222*a*" with a larger width than that of the thickness of the fixation lugs 300*a*' in order to enable a pivoting linkage between the side 220*a*' and the fixation lug 300*a*', and therefore free articulation (arrow A of FIG. 7) of the roof element I' associated with it. According to the swimming pool roof system, the rolling organs, only one of which (320*a*') is shown, ensure free movement of the side 220*a*' along the edge S, and therefore the entire associated assembly of the roof element T'.

The end cross-tie 220*a* of the portion P is preformed differently from that of the standard cross-tie 220*a*' by adopting a profile that is preferably hollow and bent with two branches 220*a*1 and 220*a*2 with an obtuse angle making it possible to ensure simultaneously both a lateral displacement towards the external side of the roof element I' or the swimming pool roof system from the position of the coupling organ 222*a*, and a vertical displacement upwards, from the position of the inclined groove 221*a* while still respecting the angle of inclination of the latter. The first branch 220*a*1 of the elbow-shaped profile forming the longitudinal side 220*a* and receiving at its low part the coupling organ 222*a* is narrow and set vertically like a post with an inclination closely adapted to the radius of curvature of the panels, and the second branch 220*a*2 receiving at its top part the inclined groove 221*a*, takes the shape of a cone with its small base being along the prolongation of the first vertical branch 220*a*1 while the big base receives at its top part the above-mentioned inclined groove 221*a*. By simply replacing the profile of the longitudinal sides 220*a*' and 220*b*' of the roof element I' by that of the longitudinal sides 220*a* and 220*b* such as shown in the drawing of FIG. 10, a roof element I is obtained that ensures, because of the presence of the cone of the second branch 220*a*2, an increase in the distance defined by the external cord of the two longitudinal sides 220*a*' and 220*b*' and therefore the spacing (only one of which is shown, 222*a*) as well as, because of the presence of the post forming the first branch 220*a*1, the raising of the height of the inclined grooves (only one of which is shown, 221*a*). This increase of distance between the coupling organs and this raising of the grooves will be parameterized at the level of the sides of the cone of the second branch 220*a*2 and those of the post of the first branch 220*a*1 to allow, without rubbing, free mobility of the juxtaposed roof elements I' of the mobile portion P' below the juxtaposed roof elements I of the other portion P.

In order to allow easy release of the fixation lugs 300*a* from the coupling organs 222*a*', especially when different roof elements I' are coupled together by U-shaped profiles 211', it is envisaged to truncate the cylindrical end 301*a*' of the fixation lugs 300*a*' along an oblique plane parallel to the longitudinal axis of the side 220*a*' so as to enable passage of the truncated cylindrical end 301*a*' of the fixation lug 300*a*' by opening the longitudinal groove 222*a*'. In fact, once the fixation lug 300*a*' is separated from its securement on the edge S of the pool, it suffices to tilt it upwards to disengage it from the runner of the coupling organ 222*a*.

Figure 11:
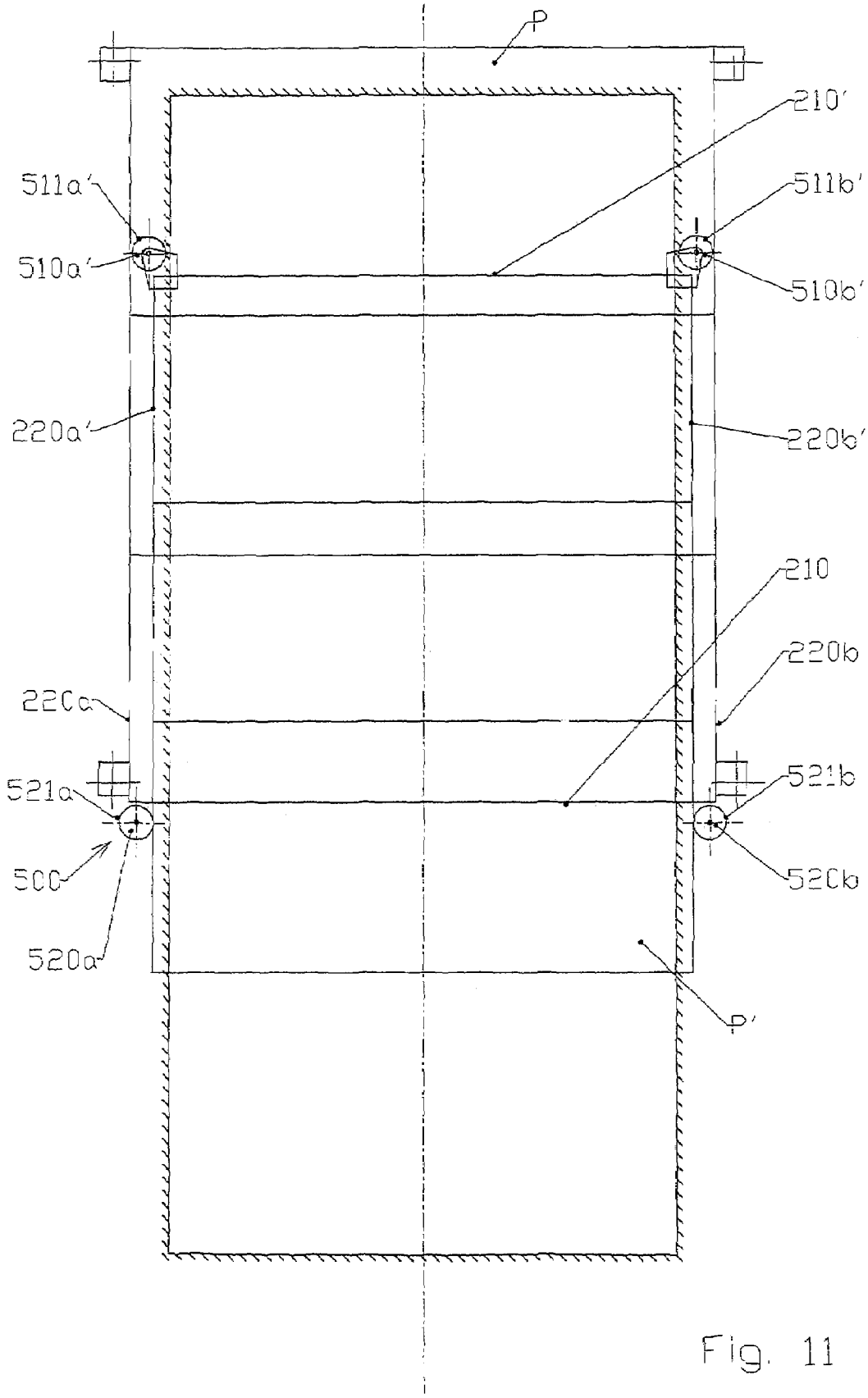
FIG. 11 is a view from above of a mobile portion and a non-mobile portion of swimming pool roof elements associated with a guide device between them.

In order to correct the significant lateral misalignments of the mobile portion P', during its displacements D inside the fixed portion P along the longitudinal axis of the swimming pool, the applicant has also envisaged installing a guide device 500 shown in the drawing of FIG. 11 and original in that it comprises:

on the one hand, at least one but preferably two guide rollers 510*a*' and 510*b*' engaged in free rotation around two vertical axes associated with the end arc 210'of the mobile portion P' extending along the fixed portion P and at the level of the two longitudinal sides 220*a*' and 220*b*' of the mobile portion P', in such a way that the rolling strips 511*a*' and 511*b*' of the guide rollers 510*a*' and 510*b*' overhang the longitudinal sides 220*a*' and 220*b*' facing the two longitudinal sides 220*a* and 220*b* of the fixed portion P while still being supported on the cross-ties formed by said longitudinal sides 220*a* and 220*b* or on the panels (100) forming a runway along the length of displacement of the mobile portion P'.

and on the other hand, at least one but preferably two counter-guide rollers 520*a* and 520*b* engaged in free rotation around two vertical axes associated with the end arc 210 of the fixed portion P along which the mobile portion P' moves and at the level of the two longitudinal sides 220*a* and 220*b* in such a way that the rolling strips 521*a* and 521*b* of the counter-guide rollers 520*a* and 520*b* overhang the vertical plane of the longitudinal sides 220*a* and 220*b* facing the two longitudinal sides 220*a*' and 220*b*' of the mobile portion P' while still being supported on the cross-ties formed by said longitudinal sides 220*a*' and 220*b*' or on the panels 100'of the mobile portion P' forming a runway along the length of displacement of the latter. Preferably, the axes of the two counter-guide rollers 520*a* and 520*b* are maintained at the level of the end arc of the fixed portion P, in a vertical position, by means of a fixation in the longitudinal edge S of the swimming pool.

Figure 12:
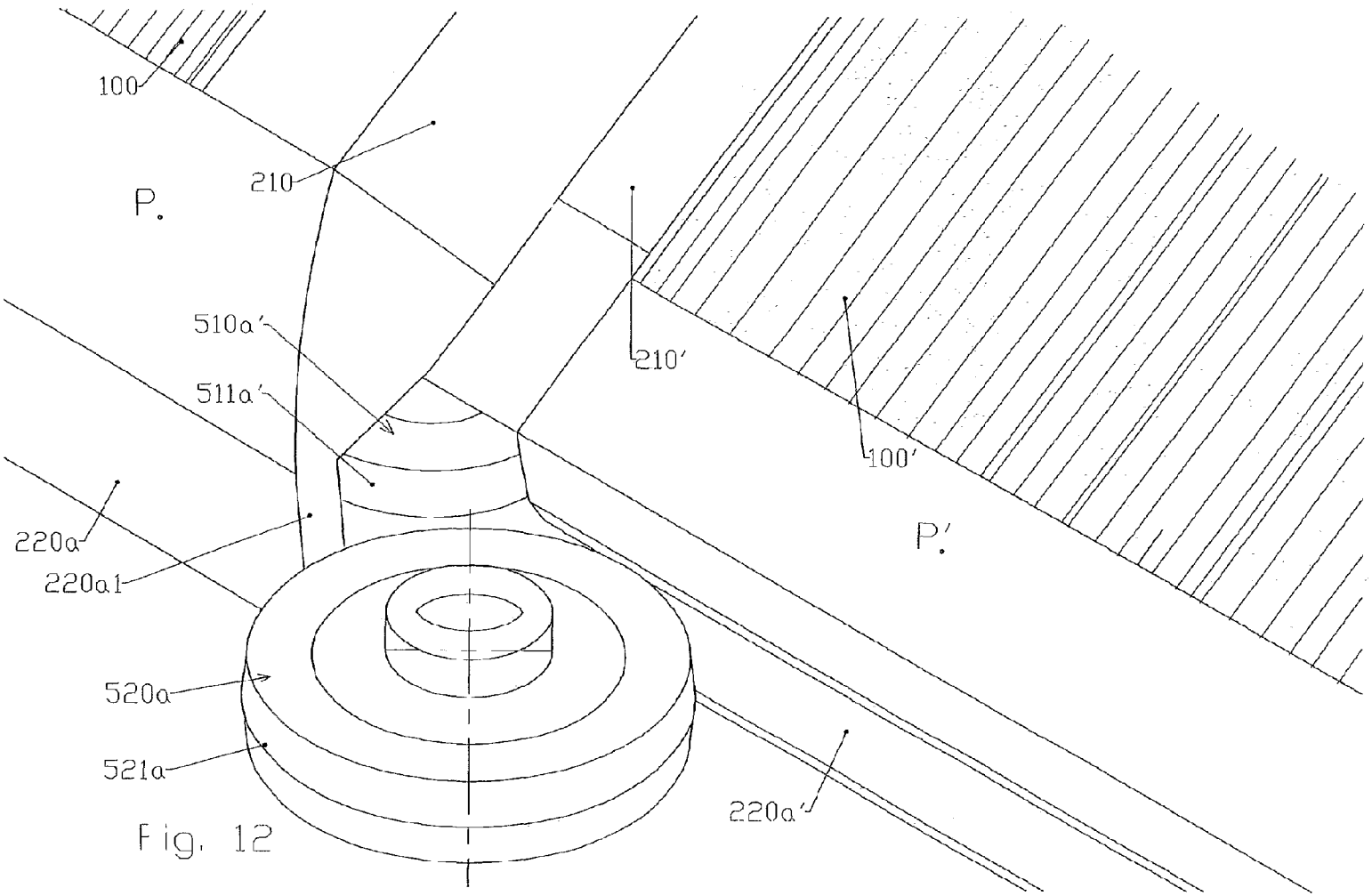
FIG. 12 is a partial isometric view in perspective of the two portions of swimming pool roof elements of the drawing of FIG. 11.
Figure 13B:
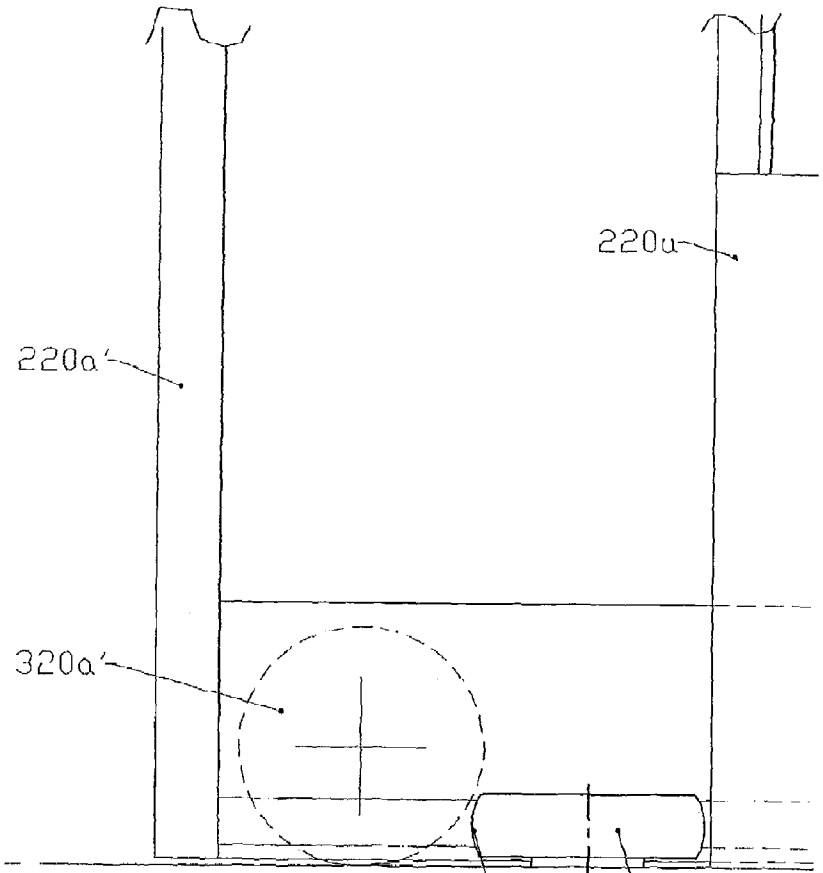
FIG. 13*b* is a view following A of the drawing of FIG. 13*a*.
Figure 13A:
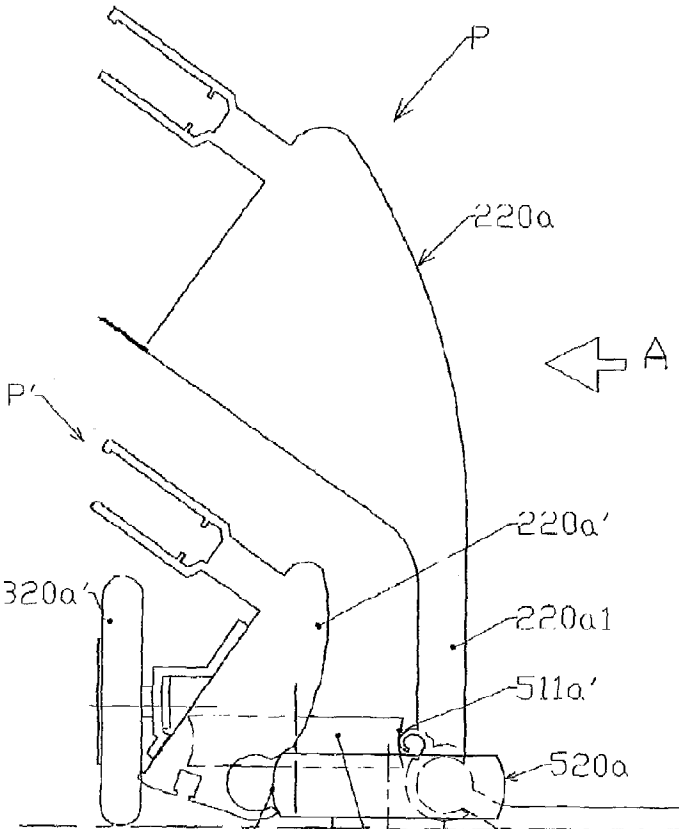
FIG. 13*a* is a partial view in vertical section of the two portions of swimming pool roof elements of the drawing of FIG. 11.

The drawing of FIG. 12 shows in more detail one (510*a*') of the two guide rollers engaged in free rotation around a vertical axis associated with the end arc 210' at the level of the longitudinal side 220*a*' of the mobile portion P' and one (520*a*) of the two counter-guide rollers engaged in free rotation around a vertical axis associated with the end arc 210 at the level of the longitudinal side 220*a*. More precisely, as can be seen in the drawings of FIGS. 13*a* and 13*b*, the rolling strip 511*a*' of the guide roller 510*a*' overhangs or extends towards the longitudinal side 220*a*' while still being supported on the internal wall of the narrow vertical part forming post 220*a*1 of the longitudinal side 220*a* of the fixed portion P, and the rolling strip 521*a* of the counter-guide roller 520*a* overhangs or extends towards the longitudinal side 220*a* while still being supported by the external wall of the longitudinal side 220*a*' of the mobile portion P'.

The pair of guide rollers 510*a*' and 510*b*' associated with the pair of counter-guide rollers 520*a* and 520*b* forming the guiding device 500 have the great advantage of being able to automatically adjust the lateral misalignments of displacements D of the mobile portion P' relative to the fixed portion P. Furthermore, when the two guide rollers 510*a*' and 510*b*' engaged in rotation around two associated axes of the end arc 210'of the mobile portion P' are partially set (as shown in the drawing of FIG. 13) or totally set in the same horizontal plane, they arrive at a stop at the end of the run against the two counter-guide rollers 520*a* and 520*b* engaged in rotation around two vertical axes associated with the end arc of the fixed portion P, in such a way as to limit the linear displacement runs D of the mobile portion P' along the longitudinal axis of the swimming pool.

It is evident that that the device 500 can be modified following several adaptations while still remaining within the context of the present invention, adaptations consisting, for example:

of adopting the same principle when the portion P is mobile and covers the fixed portion P', of not limiting the number of rollers when the swimming pool roof elements have greater dimensions, of envisaging other guide rollers or counter-guide rollers set along the length of the end arcs, for example in such a way as to bear on the cross-ties 220 and/or the panels 100 of the other portion P, of motorizing at least the guide and counter-guide rollers in order to control the displacements D of the mobile portion, of setting the axes of the guide rollers 220*a*' and 220*b*' along a significantly inclined axis relative to the vertical in such a way that the rolling strips 511*a*' and 511*b*' of said guide rollers bear on the longitudinal sides 220*a* and 220*b* of the fixed portion while still ensuring guiding, the bearing of the mobile portion P' thus replacing or substituting the above-mentioned rolling means 320*a*' allowing displacements D.

It is understood that the swimming pool roofing T described and shown above, is presented as a divulgation and not as a limitation. Evidently, various arrangements, modifications and improvements can be added to the above example, without in any way extending beyond the framework of the invention taken in its widest aspects and meaning.

The invention claimed is:

1. A low shelter swimming pool roof system, comprising:

roof elements (I and I') juxtaposed along a length of a swimming pool;

a translucent material cover (100 and 100') and a resistant rigid frame formed of at least two arcs (210 and 210') arranged in planes transverse to the pool and separated by longitudinal cross-ties (220 and 220') with two end cross-ties delimiting two longitudinal parallel sides (220*a*, 220*a*' and 220*b*, 220*b*') to the roof elements (I and I') and which rest on longitudinal edges of the swimming pool, thereby defining a support surface (S), the roof elements (I and I') having at least one longitudinal side (220*b*) articulated (arrow A) relative to the support surface (S) of the edge of the swimming pool, the articulation allowing the roof element to pivot from a closed position to a partly open position;

wherein the swimming pool roof system is formed, along at least one portion (P') of its length, of juxtaposed roof elements (I') whose distance, defined by an external cord of the two longitudinal sides (220*a*' and 220*b*') resting on support edge (S) of the swimming pool and linking the two arcs (210 and 210'), is less than the distance defined by an internal cord of the two longitudinal sides (220*a* and 220*b*) resting on the support edge (S) of the swimming pool and connecting the two arcs (210 and 210') of the juxtaposed elements (I) of the other portion (P) of the swimming pool roof system to enable nesting of a first portion (P') of the roof elements (I') in a second portion (P) of the roof elements (I) and to partially open up the swimming pool along a length depending on a displacement of a mobile portion (P') of roof elements (I'); and wherein the roof element (I') of the mobile portion (P') comprises mutual linking structure that is both dissociable to allows free articulation (arrow A) of each roof element (I') relative to the support edge (S) of the swimming pool, and non-dissociable to allow longitudinal movement of a mobile portion (P') of roof elements (I') along the support edge (S) such that the juxtaposed roof elements (I') are stowed one after the other.

2. The low shelter swimming pool roof system according to claim 1, wherein the portion (P') with the roof elements (I') is mounted so as to be mobile (arrow D) along or outside of the swimming pool, and is displaced beneath the portion (P) of the roof elements (I) to be partly or totally covered by the roof elements (I).

3. The low shelter swimming pool roof system according to claim 1, wherein the portion (P) with the roof elements (I) is mounted so as to be mobile along or outside of the swimming pool, and is displaced above the portion (P') of the roof elements (I') which it covers partly or totally.

4. The low shelter swimming pool roof system according to claim 1, wherein the mobile portion (P') of roof elements (I') is situated at one end of the swimming pool.

5. The low shelter swimming pool roof system according to claim 1, further comprising two mobile portions of roof elements (I and I') situated at the two ends of the swimming pool.

6. The low shelter swimming pool roof system according to claim 1, wherein the link between the two portions (P and P') of the roof elements (I and I') in the closed position is ensured by a partial mutual nesting of the two neighboring roof elements (I and I') with overlap of the two arcs (210 and 210') of each of the nested roof elements (I and I').

7. The low shelter swimming pool roof system according to claim 1, wherein the two arcs (210 and 210') of the roof elements (I and I') of the portion (P) and the mobile portion (P') have a same radius of curvature.

8. The low shelter swimming pool roof system according to claim 1, wherein the longitudinal side (220*a*, 220*b* and 220*a*', 220*b*') of the roof element (I and I') of the portion (P) and the mobile portion (P') are profiled to receive in a removable or adjustable manner, either fixation lugs (310*a*) of the roof elements (I) on the support edge (S), or displacement means (320*a*') of the roof elements (I') along and outside of the support edge (S).

9. The low shelter swimming pool roof system according to claim 1, wherein linking means comprise wings of the two arcs (210 and 210') that, arranged overhanging the prolongation of panels of the translucent material cover (100) to partially seal the nesting of the juxtaposed roof elements (I') in the closed position, are provided with a removable device for solidarization the wings with the arc (210') of an adjacent roof element (I').

10. The low shelter swimming pool roof system according to claim 9, wherein each means for linking two contiguous arced couplings (210*r*' and 210*c*') includes a U-profile (211') which, taking shapes of rectangular lower profiles (212*r*' and 212*c*') of the two contiguous arced couplings (210*r*' and 210*c*'), is made integral with the rectangular profile (212*r*') of the arced coupling (210*r*') of the roof element (I') in such a way that the rectangular profile (212*c*') of the arced coupling (210*c*') of the roof element (I) can be lodged in the U-shaped profile (211') during the lowering movement of the roof element (I) into the closed position and inversely, to release the U-shaped profile (211') during the lifting movement of the same element to obtain an open-position.

11. The low shelter swimming pool roof system according to claim 10, wherein an upper part of a branch of the U-shaped profile (211') not firmly attached to the arced coupling (210*r*') of the roof element (I') is flared to facilitate engaging the rectangular lower profile (212*c*') of the arced coupling (210*c*') of the roof element (I) with play, during its lowering movement into the closed position.

12. The low shelter swimming pool roof system according to claim 1, wherein the two end cross-ties of the frame delimiting two longitudinal sides (220*a*, 220*a*' and 220*b*, 220*b*') to the roof element (I and I') are each arranged at their upper part and facing towards an internal side of the roof elements (I and I') with a projecting inclined groove (221*a* and 221*a*') to grab and retain an edge of the translucent material cover (100 and 100') at their lower part and facing towards an external side of the roof elements (I and I'), with a coupling organ (222*a* and 222*a*') in order to retain, via fixation lugs (300*a*, 300*a*' and 300*b*, 300*b*') of the roof elements (I and I') on the edge (S) of the swimming pool, wherein each of two end cross-tie (220*a*) of the portion (P) of the roof elements (I) receiving the coupling organ (222*a*) and the groove (221*a*) is preformed with a profile bent with a first brand (220*a*1) and a second branch (220*a*2) with an obtuse angle to ensure simultaneously both a lateral displacement towards the external side of the roof elements (I and I') from the position of the coupling organ (222*a*), and a vertical displacement upwards, from the position of the inclined groove (221*a*), while still respecting the angle of inclination of the inclined groove (221*a*).

13. The low shelter swimming pool roof system according to claim 12, wherein the first branch (220*a*1) of the profile forming the end cross-tie (220*a*) and receiving at its low part the coupling organ (222*a*) is narrow and set vertically like a post, and wherein a second branch (220*a*2) receiving at its top part the inclined groove (221*a*), takes the shape of a cone with a small base along the prolongation of the first branch (220*a*1) with a vertical orientation while a big base receives at its top part the inclined groove (221*a*).

14. The low shelter swimming pool roof system according to claim 12, wherein the coupling organ (222*a*') of the longitudinal sides (220*a*') is formed following the profile of the cross-tie of the longitudinal sides (220*a*') along a runner of circular cross-section open to the exterior of a longitudinal groove (222*a*') with a relatively bigger width than that of the thickness of the fixation lugs (300*a*') in order to enable a pivoting linkage between the longitudinal sides (220*a*') and a cylindrical end (301*a*') of the fixation lugs (300*a*'), wherein the cylindrical end (301*a*') of the fixation lug (300*a*') is truncated along an oblique plane parallel to a longitudinal axis of the longitudinal sides (220*a*') so as to enable passage of the truncated cylindrical end (301*a*') of the fixation lug (300*a*') by the longitudinal groove (222*a*') of the coupling organ (222*a*').

15. The low shelter swimming pool roof system according to claim 1, in which either a portion (P') of roof elements (I') or a portion (P) of roof elements (I) is mounted in a mobile arrangement (arrow D) along the swimming pool, wherein the displacements (D) of the mobile portion (P') are guided along a longitudinal axis of the swimming pool by at least one guide roller (510*a*' or 510*b*') engaged in rotation around a vertical axis associated with the arc (210') located at an end of the mobile portion (P') such that a rolling strip (511*a*' or 511*b*') of the guide roller (510*a*') or 510*b*') at least partially extends towards the mobile portion (P') facing the portion (P) while still being supported on the cross-ties (220) or on panels of translucent material cover (100) of the portion (P) forming a runway along the length of displacement of the mobile portion (P').

16. The low shelter swimming pool roof system according to claim 15, wherein the displacements (D) of the mobile portion (P') are guided (arrow D) along the longitudinal axis of the swimming pool by two guide rollers (510*a*' and 510*b*') engaged in rotation around two axes associated with the arc (210') located at an end of the mobile portion (P') and approximately level with the two longitudinal sides (220*a*' and 220*b*'), in such a way that the rolling strips (511*a*' and 511*b*') of the guide rollers (510*a*' and 510*b*') at least partially extends towards the longitudinal sides (220*a*' and 220*b*') of the mobile portion (P') facing the two longitudinal sides (220*a* and 220*b*) of the portion (P) while still being supported on the two longitudinal sides (220*a* and 220*b*) of the portion (P) forming a runway along the length of displacement of the mobile portion (P').

17. The low shelter swimming pool roof system according to claim 15, wherein the guide rollers (510*a*' and 510*b*') are arranged with the arc (210') located at an end of the mobile portion (P') moving along the portion (P).

18. The low shelter swimming pool roof system according to claim 15, wherein the axes of the two guide rollers (510*a*' and 510*b*') are arranged in vertical planes.

19. The low shelter swimming pool roof system according to claim 15, wherein the axes of the guide rollers (510*a*' and 510*b*') are arranged in inclined planes such that guiding, bearing and displacement (arrow D) of the mobile portion (P') is ensured.

20. The low shelter swimming pool roof system according to claim 1, in which either the portion (P') of small roof elements (I') or the portion (P) of roof elements (I) is mounted in a mobile arrangement (arrow D) along the swimming pool, wherein the displacements D of the mobile portion (P') are guided along a longitudinal axis of the swimming pool by at least one counter guide roller (520*a* or 520*b*) engaged in rotation around an axis associated with the arc (210) located at an end of the portion (P') around a vertical axis associated with the arc (210') located at an end of the mobile portion (P') such that a rolling strip (521*a* or 521*b*) of the counter-guide roller (520*a* or 520*b*) overhang the plane of portion (P) facing the mobile portion (P') while still being supported on the cross-ties (220') or on panels of translucent material cover (100') of the mobile portion (P') forming a runway along the length of displacement of panels of translucent material cover (100').

21. The low shelter swimming pool roof system according to claim 20, wherein the displacements (D) of the mobile portion (P') are guided (arrow D) along the longitudinal axis of the swimming pool by two counter-guide rollers (520*a* and 520*b*) engaged in rotation around two axes associated with the arc (210) located at an end of the portion (P) at the level of the two longitudinal sides (220*a* and 220*b*), in such a way that the rolling strips (521*a* and 521*b*) of the counter-guide rollers (520*a* and 520*b*) overhang the plane of the longitudinal sides (220*a* and 220*b*) of the portion (P) facing the two longitudinal sides (220*a*' and 220*b*') of the mobile portion (P') while still being supported on the two longitudinal sides (220*a*' and 220*b*') of the mobile portion (P') forming a runway along the length of displacement of that latter.

22. The low shelter swimming pool roof system according to claim 20, wherein the counter-guide rollers (520*a* and 520*b*) are arranged with the arc (210) located at an end of the portion (P or P') along which the mobile portion (P' or P) moves.

23. The low shelter swimming pool roof system according to claim 20, wherein the axes of the two counter-guide rollers (520*a* and 520*b*) are arranged, at the level of the arc (210) located at an end of the portion (P) along which the mobile portion (P') moves, in a vertical plane by means of a fixation in the longitudinal edges (S) of the swimming pool.

24. The low shelter swimming pool roof system according to claim 15, wherein the guide rollers (510*a*' or 510*b*') or counter-guide rollers (520*a* and 520*b*) are engaged in free rotation around their axes.

25. The low shelter swimming pool roof system according to claim 15, wherein at least one of the guide rollers (510*a*' or 510*b*') or of the counter-guide rollers (520*a* and 520*b*) is motorized.

26. The low shelter swimming pool roof system according to claim 15, wherein the displacements (D) of the mobile portion (P') are guided (arrow D) along the longitudinal axis of the swimming pool: by two guide rollers (510*a*' and 510*b*') engaged in free rotation around two vertical axes associated with the arc (210') located at an end of the mobile portion (P') extending along the portion (P) and at the level of the two longitudinal sides (220*a*' and 220*b*'), such that the rolling strips (511*a*' and 511*b*') of the guide rollers (510*a*' and 510*b*') overhang the plane of the longitudinal sides (220*a*' and 220*b*') facing the two longitudinal sides (220*a* and 220*b*) of the portion (P) while still being supported on the cross-ties formed by the longitudinal sides (220*a* and 220*b*) forming a runway along the length of displacement of the mobile portion (P'), or by two counter-guide rollers (520*a* and 520*b*) engaged in free rotation around two vertical axes associated with the arc (210) located at an end of the portion (P) along which the mobile portion (P') moves and at the level of the two longitudinal sides (220*a* and 220*b*) in such a way that the rolling strips (521*a* and 521*b*) of the counter-guide rollers (520*a* and 520*b*) overhang the plane of the longitudinal sides (220*a* and 220*b*) of the portion (P) facing the two longitudinal sides (220*a*' and 220*b*') of the mobile portion (P') while still being supported on the two longitudinal sides (220*a*' and 220*b*') of the mobile portion (P') forming a runway along the length of displacement of the latter.

27. The low shelter swimming pool roof system according to claim 26, wherein the two guide rollers (510*a*' and 510*b*') engaged in rotation around two associated axes of the arc (210') located at an end of the mobile portion (P') moving along the portion (P) are partially set or totally set in the same horizontal plane as the plane of the two counter-guide rollers (520*a* and 520*b*) engaged in rotation around two vertical axes associated with the arc (210) located at an end of the portion (P) along which the mobile portion (P') moves, in such a way as to arrive at a stop at an end of a run against that latter and in such a way as to limit the end linear displacement runs D of the mobile portion P' along the longitudinal axis of the swimming pool.

* * * * *